United States Patent [19]

Hofmann et al.

[11] 4,190,401

[45] Feb. 26, 1980

[54] LOCK ASSEMBLY FOR A DRIVE SHAFT OF A FUEL INJECTION PUMP FOR INTERNAL COMBUSTION ENGINES

[75] Inventors: Eberhard Hofmann, Kirchberg; Erwin Weyrich, Ludwigsburg, both of Fed. Rep. of Germany

[73] Assignee: Robert Bosch GmbH, Stuttgart, Fed. Rep. of Germany

[21] Appl. No.: 853,670

[22] Filed: Nov. 21, 1977

[30] Foreign Application Priority Data

Nov. 22, 1976 [DE] Fed. Rep. of Germany ..... 2652950

[51] Int. Cl.[2] ..... F04B 39/00

[52] U.S. Cl. ..... 417/313; 123/139 AP; 123/139 AZ; 403/14

[58] Field of Search ..... 123/139 AP, 139 AZ, 123/139 AA; 417/313, 238; 192/12; 403/13, 14; 92/128

[56] References Cited

U.S. PATENT DOCUMENTS

| | | | |
|---|---|---|---|
| 1,640,509 | 8/1927 | Lowe | 123/139 AZ |
| 2,488,361 | 11/1949 | Witzky et al. | 123/139 AP |
| 4,008,981 | 2/1977 | Bouquet | 123/139 AA |

FOREIGN PATENT DOCUMENTS

| | | | |
|---|---|---|---|
| 2438313 | 9/1976 | Fed. Rep. of Germany | 417/313 |

*Primary Examiner*—Carlton R. Croyle
*Assistant Examiner*—Edward Look
*Attorney, Agent, or Firm*—Edwin E. Greigg

[57] ABSTRACT

A lock assembly for restraining a drive shaft of a fuel injection pump in a definite rotary position that corresponds to the initial point of fuel injection for an internal combustion engine. The lock assembly which can be removed after installation of the pump in a motor vehicle includes an elastic deformable element that has a portion thereof that is rigidly connected adjacent to one end wall of the pump housing and further includes another portion that is secured to an element driven by the drive shaft.

3 Claims, 6 Drawing Figures

LOCK ASSEMBLY FOR A DRIVE SHAFT OF A FUEL INJECTION PUMP FOR INTERNAL COMBUSTION ENGINES

BACKGROUND OF THE INVENTION

The invention relates to a means for locking a drive shaft of a fuel injection pump of an engine in a definite position, especially a position that corresponds to the initial point of injection, by means of a device the position of which is fixed relative to the pump housing. By means of this device a force and friction fitted connection, which holds the drive shaft in a set definite rotary position, can be produced by means of an element that is firmly attached to the drive shaft.

With fuel injection pumps of series construction it is necessary to restrain the position of the cam shaft and its first cam at the point when fuel injection is to take place, that is the rotary position which corresponds to the beginning of injection should be properly confined in order to be able to install the injection pump with the internal combustion engine. In distribution type fuel injection pumps the drive shaft is normally held in a set rotary position which is correlated with the initial point of injection.

Heretofore, in order to be able to designate this supply beginning position, it has been required to correlate several indicia points, e.g., one would apply an index line on a part connected firmly to the drive shaft with a second index line applied to the front side of the pump, or with an index line on a movable part, if the fixed index has been applied to the pump housing. This known type of adjustment has the serious disadvantage that the index line may not be visible from the outside if the pump is mounted with its front flange secured to the gear casing of the internal combustion engine. When a pump is being mounted on the internal combustion engine it is often necessary to have to start all over to determine the initial point of injection. This can be done by the so-called "overflow method," and is achieved when the disassembled pressure valve of the pump suction chamber is placed under fuel pressure and the pump with a coupled and stationary drive shaft is slowly rotated until the pump piston, by its upward stroke, closes the suction bore and fuel stops flowing. In this position the fuel injection pump, now set at the initial injection point, is secured into place with the internal combustion engine. This method of adjustment takes a great deal of time and can only be performed by highly-trained technicians. Thus it is apparent that even with accessible index lines the adjustments which must be made during installation of the pump on the internal combustion engine is very dependent on the skill of the mechanic.

Locking assemblies for a drive shaft of a fuel injection pump that is capable of restraining the drive shaft at an initial injection point are known (DT-AS No. 24 38 313). These devices include a locking pin which is pressed against a surface of the part connected with the drive shaft, with this surface being arranged coaxially of the drive shaft axis and uniformly cylindrical in the area of installation of the locking pin. A spring is acted upon radially from the outside toward the drive shaft axis, and thus produces a force and friction fitted connection to thereby lock the drive shaft in the desired rotary position. Although the force acting on the drive shaft is limited by the spring, there is nevertheless a force loading the drive shaft which is not desirable. In addition, it is disadvantageous that a uniformly cylindrical surface must always be available and arranged coaxially to the drive shaft axis so that the manner of positioning the device with respect to the pump or governor is fixed in advance. Pump or governor housings must, in addition, be provided for the mounting of the device. The assemblying of the device with an internal combustion engine is also dependent on the specific location under the bonnet or hood where it may be placed and a uniform installation is not possible even for the same pump or governor models unless it is for use with identical engines.

OBJECT AND SUMMARY OF THE INVENTION

Accordingly, the principal object of the present invention is to provide a locking assembly for a drive shaft of a fuel injection pump that is capable of restraining the drive shaft at an initial injection position and more particularly where the locking assembly includes means for mounting the lock structure in juxtaposition relative to a front wall of the pump and comprises bolt means that cooperate with yieldable means that are associated with the drive shaft and arranged to prevent rotation thereof.

Another object of the present invention is that the improved structure can be applied to any fuel injection pump without the necessity of having to obtain access to the interior of either the pump or the governor.

Still another object of the present invention is to eliminate all radial loading on the drive shaft bearing of the fuel injection pump.

A further object of the invention is to provide a locking device one portion of which is arranged to cooperate with a support member for the front drive shaft bearing while another portion thereof telescopes a member that is coextensive with the drive shaft and soft soldered thereto.

A still further object of the invention is to provide the drive shaft of the fuel injection pump with a multiple disc clutch member to which is attached a frangible locking device one extremity of which is secured to a support for the front bearing of the drive shaft of the pump by a bolt.

Yet another object of the invention is to provide a coupling member that is affixed to the drive shaft of the fuel injection pump with a clamping means that is adapted to restrain rotation of the drive shaft by being associated with a means that stands off from the support member for the front device shaft bearing.

The invention will be better understood as well as further objects and advantages thereof become more apparent from the ensuing detailed description taken in conjunction with the drawings.

DESCRIPTION OF THE PREFERRED EMBODIMENTS

Figure 1:
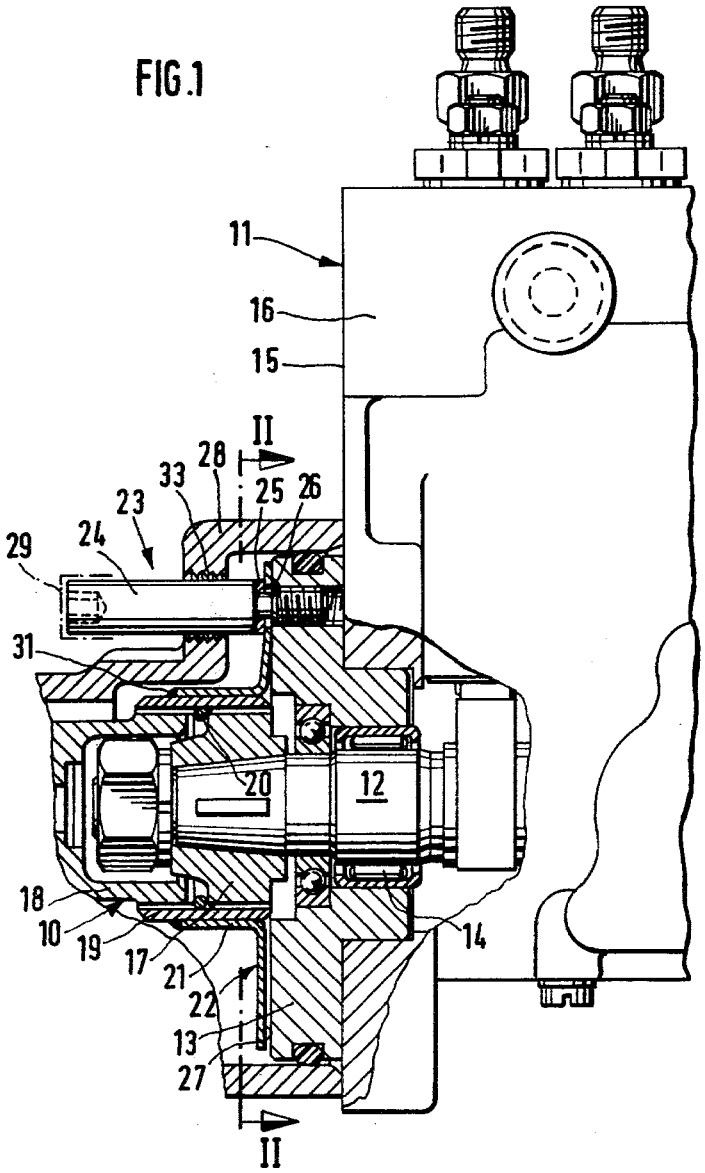
FIG. 1 is a side elevational view of a fuel injection pump showing the locking assembly and appurtenant structure of the pump in cross section.
Figure 2:
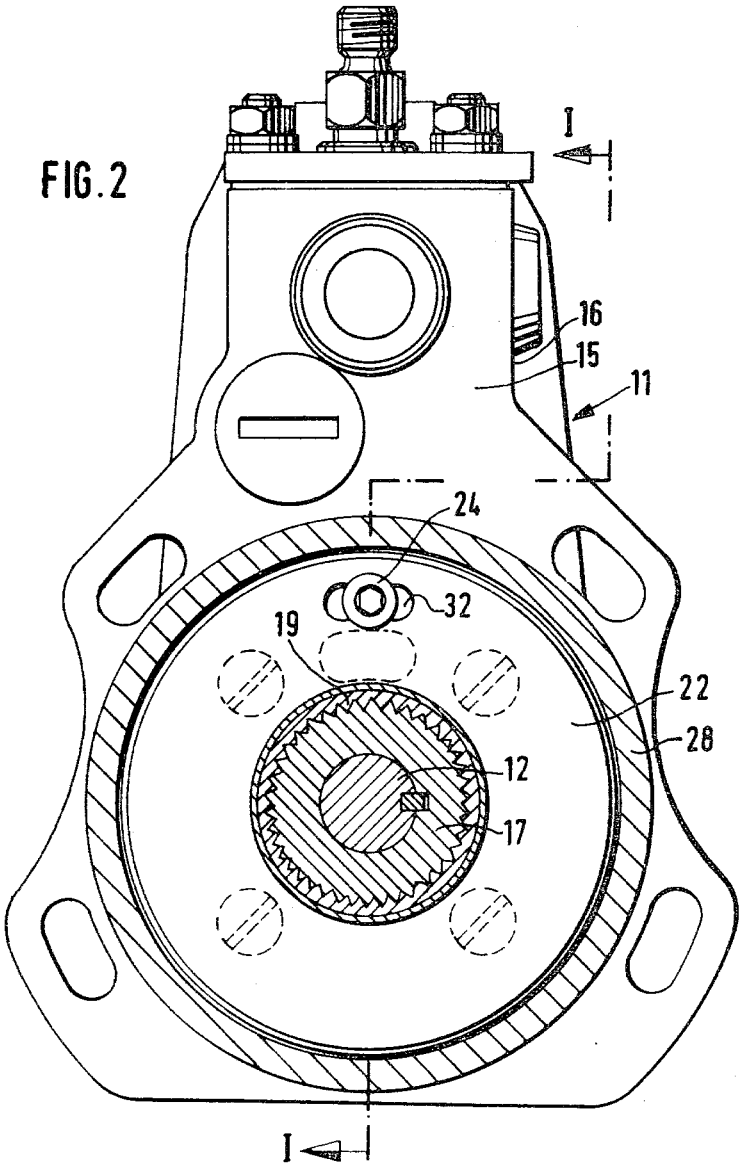
FIG. 2 is a view on line II—II of FIG. 1.

Turning now to the drawings and more particularly to the first exemplary embodiment illustrated in FIGS. 1 and 2, the locking assembly according to the invention is arranged adjacent to a drive coupling 10 of a fuel injection pump 11. The fuel injection pump 11, which is embodied in a known manner as a series injection pump, has a cam shaft 12 which serves as the drive shaft, said cam shaft being supported by means of a bearing 14 that is mounted in a bearing cover 13 that is arranged in juxtaposition with the drive surface 15 of a pump housing 16. The second bearing for the cam shaft 12 is included in a known manner in a governor housing and is not illustrated here.

The drive coupling 10 in the present embodiment is formed as a gear coupling and has a coupling member 17 provided with external teeth, said member being firmly connected with the cam shaft 12. The drive coupling 10 also has an additional drive coupling member 18, which is provided with external teeth and extends axially of the cam shaft. Both of these drive couplings 17,18 are rigidly connected with an encompassing coupling sleeve 19 by means of internal teeth provided thereon and a snap ring or circlip 20 is interposed therebetween, as shown.

The coupling sleeve 19 is encompassed by a driving collar 21, which includes an integral annular flange 22 that is arranged to be tightened by an elongated shank element 23 in a definite rotary position to lock the cam shaft 12 before the injection pump 11 is placed in operation. This element may be manufactured from any suitable springy or resilient material such as sheet steel. The cam shaft 12 is held in place in the direction of the long axis thereof against the bearing cover 13 by both force and friction fitting. The elongated shank 23 comprises a locking screw 24, which serves as the locking means for the deformable annular flange 22. Thus, it will be seen that the flange 22 is force fitted against the front surface 27 of the bearing cover 13 by means of the locking screw 24 and is thereby mediately connected with the corresponding front surface 15 of the injection pump 11.

The locking screw 24 projects visibly out of a drive housing 28 and is made clearly visible to service personnel by being painted with an appropriate color 29 such as depicted by the broken lines, so that the engine will not be operated before removal of the locking screw 24. However, in the event the locking screw is not removed by personnel, then a soft soldered connection 31 that exists between the collar 21 that is carried by the flange 22 and the coupling sleeve 19 serves as a frangible joint, so that no damage can occur to the drive or pump parts. Thus, the flange 22 is rigidly connected with the cam shaft 12 by means of the intermediate coupling of the coupling sleeve 19, the drive coupling 17, and the frangible joint 31, formed by the soft solder. In order to achieve a good contact surface between the pressure shoulder 26 of the locking screw 24 and the flange 22, this flange as illustrated in FIG. 2, is provided with an elongated aperture 32 in the area of its outer edge opposite the drive shaft 12 and by means of which the locking screw 24 can be threaded into the bearing cover 13.

The locking screw 24 is inserted through a threaded bore 33 that is provided in the drive housing 28. During operation of the internal combustion engine and the injection pump 11, this threaded bore 33 is closed off with a blanking plug in a manner not shown, but only, of course, after the locking screw 24 has been removed.

By means of the spring elastic embodiment of the flange 22, the part of the flange 22 that is tightened against the front surface 27 of the bearing cover 13 by the locking screw 24, and which is located in the area of the elongated aperture 32, springs back into its original position spaced from the front surface 27 when the screw 24 is removed, so that during normal operation the flange 22 does not rub against the bearing cover 13.

Figure 3:
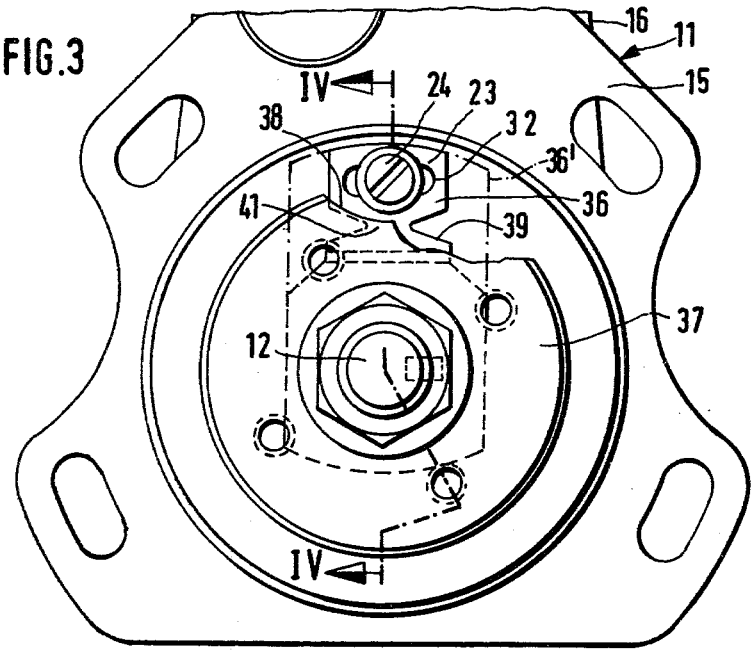
FIG. 3 is a partial front elevational view of a second embodiment of the invention showing a frangible means.
Figure 4:
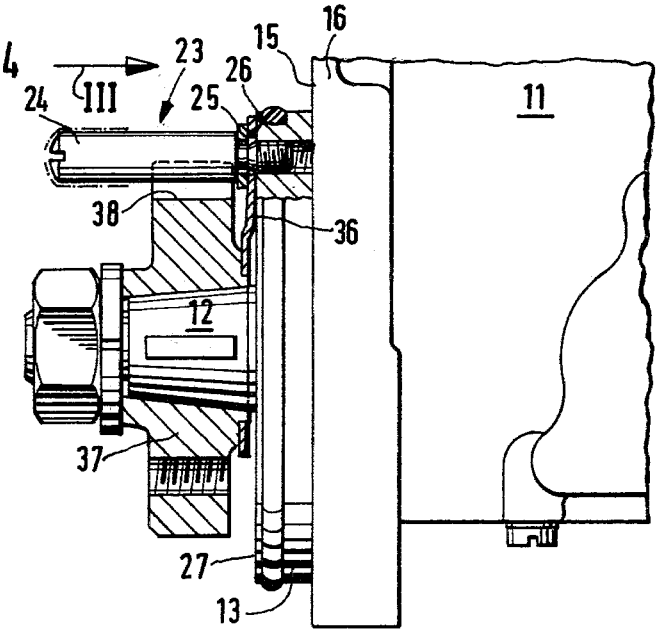
FIG. 4 is a view on line III—III of FIG. 3.

In the second exemplary embodiment of this invention as illustrated in FIGS. 3 and 4, the elements that correspond to those in the first embodiment of the invention are given the same reference numerals as used earlier herein or are provided with such indicia that will indicate that they are materially changed in their form or position.

As can be seen from the FIG. 3 or 4, the elongated shank comprises the locking screw 24 with the pressure shoulder 26, which pressure shoulder 26 tightens a lever arm having an outwardly extending spring elastic retention plate 36, against the front surface 27 of the bearing cover 13, to hold the cam shaft 12 in place in a definite rotary position that corresponds to the beginning of the fuel supply. In this manner the retention plate 36 is force and friction fitted in the direction of the long axis of the cam shaft 12 toward the pump housing 16.

The retention plate 36 is attached to a coupling member 37 so as to be rigid with the drive shaft 12, and in the area of its outer edge opposite the cam shaft 12, is provided with the elongated aperture 32, such as was described relative to flange 22 in FIG. 2. By means of this elongated aperture 32, the locking screw 24 can be threaded into the bearing cover 13 in the manner illustrated.

The coupling member 37 comprises a multiple disc clutch of a known type that is not illustrated in greater detail and further elements of which are connected with an engine shaft. The coupling member 37 has a recess 38 in the area near the locking screw 24.

Between the elongated aperture 32 which receives the locking screw 24 and its connection with the driving collar of the coupling member 37, the retention plate 36 is provided with weakened areas 39, which define a preset breaking point that resembles in function the soft solder joint in the first exemplary embodiment. These weakened areas are formed by clipping two oppositely extending triangular portions out of the retention plate 36 as is shown in FIG. 3. The unsevered zone 41 that remains between the clipped portions 39 determines the force at which the retention plate 36 will break if the locking screw 24 is accidentially left in the pump when the engine is started, thus preventing damage to important components.

Figure 5:
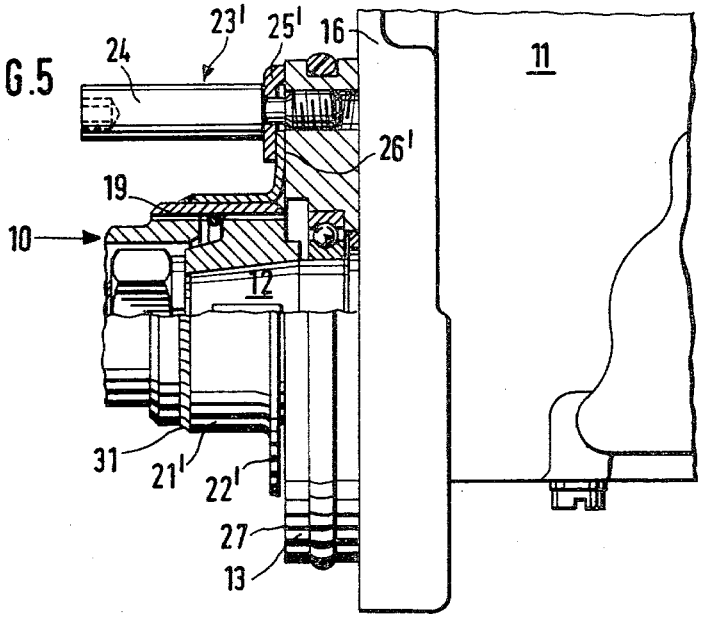
FIG. 5 is a partial side elevational and cross-sectional view of another embodiment of the invention.

The third exemplary embodiment, illustrated only partially in FIG. 5, deviates only slightly from the first embodiment shown in FIG. 1. The spring elastic flange 22' is connected with the coupling sleeve 19 of the drive coupling 10 by means of a driving collar 21' and the soft solder connection 31, and serves thereby as an element that is rigidly connected with the cam shaft 12. The outside diameter of the flange 22' is just large enough to reach the threaded portion of the locking screw 24, which includes the element denoted 23' to lock the drive shaft in a definite position of rotation, and has an adjacent surface of a clamping shoe or dog 25' as a pressure shoulder 26' positioned against the flange 22'. By means of the clamping dog 25' the outer edge of the flange 22′ can be tightened against the front surface 27 of the bearing cover 13 to lock the drive shaft in a definite rotary position, so that a force and friction fitted connection is thereby formed between the pump housing 16 and the cam shaft 12. The clamping dog 25′ is preferrably formed as a disc, so that it, together with the locking screw 24 can be more easily removed by means of a corresponding bore (not shown) in the drive housing.

Figure 6:
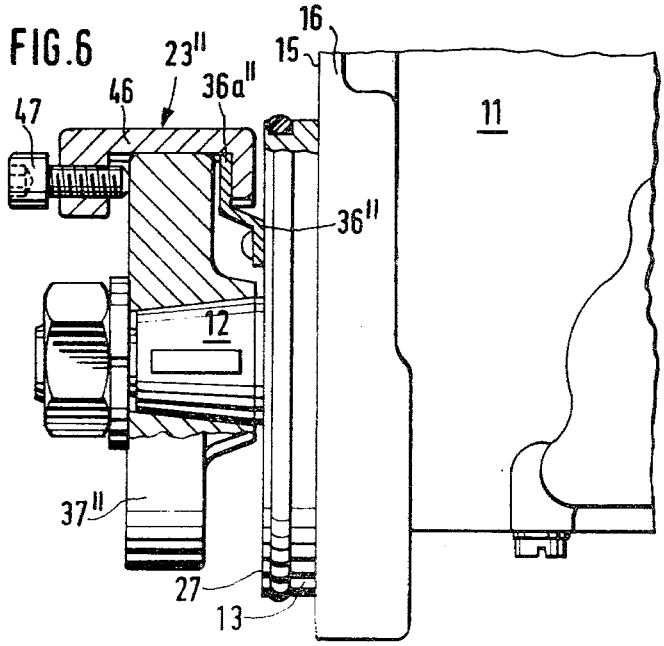
FIG. 6 is a partial side elevational and cross-sectional view of still another embodiment of the invention.

In the fourth exemplary embodiment according to FIG. 6, the locking device is designated by 23″, and the spring elastic element comprises a retention plate 36″ that is firmly connected with the front surface 27 of the bearing cover 13 and with the pump housing 16. The retention plate 36″ can be tightened by means of its spring elastic, outwardly extending end 36*a*″ opposite the drive shaft 12, against a coupling member 37″. In this manner the edges of both elements 36″ and 37″ have the same radial distance from the drive shaft 12. The end 36*a*″ of the outwardly extending retention plate 36″ can be force and friction fitted against the coupling member 37″ by means of a threaded bolt 46, which cooperates with a clamping member 23″ that resembles a c-clamp.

Also, in FIG. 6, in contrast to the illustrations in FIGS. 1, 4 and 5, the retention plate 36″, the coupling member 37″ and the clamp 46 are illustrated in the position before the clamp 46 has been tightened, for the original operation of the retention plate 36″. Thus, from the foregoing it is apparent that the force and friction fitted connection necessary to secure the cam shaft 12 in a definite rotary position is achieved by tightening the threaded bolt 47.

Relative to all of the embodiments of the invention illustrated in the various views of FIGS. 1 through 6, all embodiments share the common advantageous feature of not exerting any axial loads on the cam shaft 12 or their bearings 14 (FIG. 1).

Accordingly, it will be understood from the foregoing that all of the locking structures disclosed herein are intended to remain in the illustrated installed position only during transport and installation of the injection pump 11 onto the engine, and are to be removed after the fastening of the pump installation flange on the gear housing or installation flange of the engine. In some instances as noted hereinbefore, the locking elements, after removal, are replaced by a sealing means in the drive housing, as mentioned earlier with regard to FIG. 1.

The invention disclosed herein, of course, concerns not only the embodiments illustrated in the drawings, but in addition the retention plate 36 provided with a preset breaking point in FIG. 3 can also be built without this preset breaking point as shown by the broken line 36′.

Thus, in the embodiments illustrated in FIGS. 1, 2 and 5, in which the member that is nonrotationally connected with the drive shaft is fastened as a flange 22, 22′ to the coupling sleeve 19, the axial play of this coupling sleeve 19 can also be arranged so that said flanges are pressed against the front surface 27 of the bearing cover 13 by the locking screw 24 and its pressure shoulder 26 and 26′. In this manner the necessary force and friction fitted connection can be produced. When the locking screw 24 is loosened, the coupling sleeve 19 with the flanges 22,22′ will move away from the bearing cover 13. Spring means also can be arranged between the coupling member 17 and the coupling sleeve 19, which are supported if necessary, inside the coupling sleeve 19 on the circlip 20 which serves to secure the position. In this case the entire apparatus with the flanges 22,22′ would be formed of elastic material.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A locking assembly for the drive shaft of a fuel injection pump for releasably fixing the rotary position of the shaft within the pump housing at a predetermined point corresponding to the initial point of fuel injection for an internal combustion engine prior to installation of the pump on the engine, comprising:

said pump, including a housing and a drive shaft extending outwardly of said housing;

means firmly connected to said drive shaft for rotation therewith, said means having a portion which is flexible axially of said shaft; and locking means for releasably clamping said flexible portion to said housing.

2. A locking assembly as defined by claim 1 in which the connection of said first named means to said shaft includes a soft solder frangible joint for preventing damage in the event of engine start up without removal of said locking means.

3. A locking assembly as defined by claim 1 in which said first named means has a weakened frangible portion for preventing damage in the event of start up without removal of said locking means.

* * * * *